United States Patent [19]

Bickis, Sr.

[11] 3,967,347

[45] July 6, 1976

[54] BUCKLE CONSTRUCTION

[75] Inventor: George J. Bickis, Sr., Massillon, Ohio

[73] Assignee: Indenco, Inc., Massillon, Ohio

[22] Filed: Mar. 27, 1975

[21] Appl. No.: 562,793

[52] U.S. Cl. ..... 24/74 A; 24/200; 24/193

[51] Int. Cl.[2] ..... A44B 11/00; A44B 11/02

[58] Field of Search ..... 24/74 A, 74 R, 79, 198, 24/200, 22, 23 B, 193

[56] References Cited

UNITED STATES PATENTS

| | | | |
|---|---|---|---|
| 139,777 | 6/1873 | Cook | 24/22 |
| 728,206 | 5/1903 | Crafts | 24/74 A |
| 3,206,816 | 9/1965 | Vilcins et al. | 24/74 A |
| 3,271,831 | 9/1966 | Litwin | 24/200 |
| 3,414,943 | 12/1968 | Hattori | 24/74 A |

FOREIGN PATENTS OR APPLICATIONS

| | | | |
|---|---|---|---|
| 827,366 | 1/1964 | Canada | 24/74 A |

*Primary Examiner*—Bernard A. Gelak
*Attorney, Agent, or Firm*—Frease & Bishop

[57] ABSTRACT

A buckle for securing plastic strapping around an object. A pair of independently movable fingers are hingedly mounted by flexible plastic strips in spaced relationship on a rectangular base. The base has spaced pairs of integral side and end members which form a rectangular aperature therebetween. The fingers are adapted to be folded into superimposed, overlapped position along the side frame members. A post is formed on each of the end members at the midpoints thereof. The posts lie between the spaced ends of the fingers and in close proximity thereto when the fingers are in folded position. The fingers extend through loops formed in the ends of the strapping material with the finger ends being drawn inwardly against the posts upon tensioning of the strap. The posts absorb much of the tensioning force exerted on the fingers and distribute the remaining force equally on the fingers, thereby reducing twisting and breaking of the fingers during installation.

8 Claims, 13 Drawing Figures

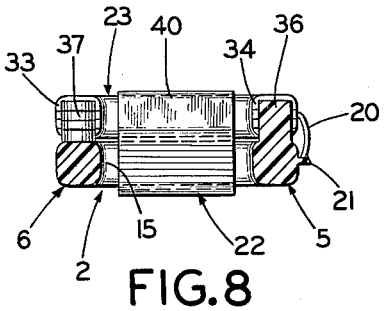
FIG.8
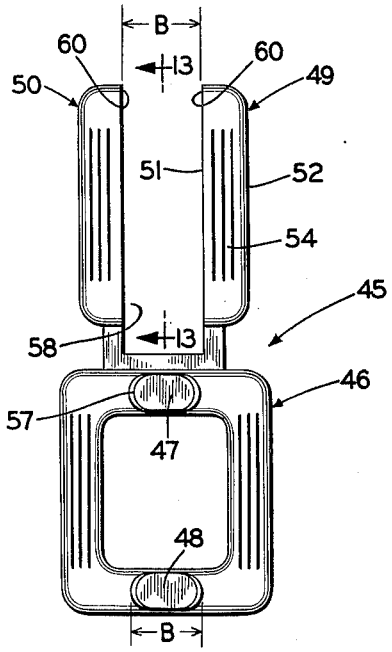
FIG.10
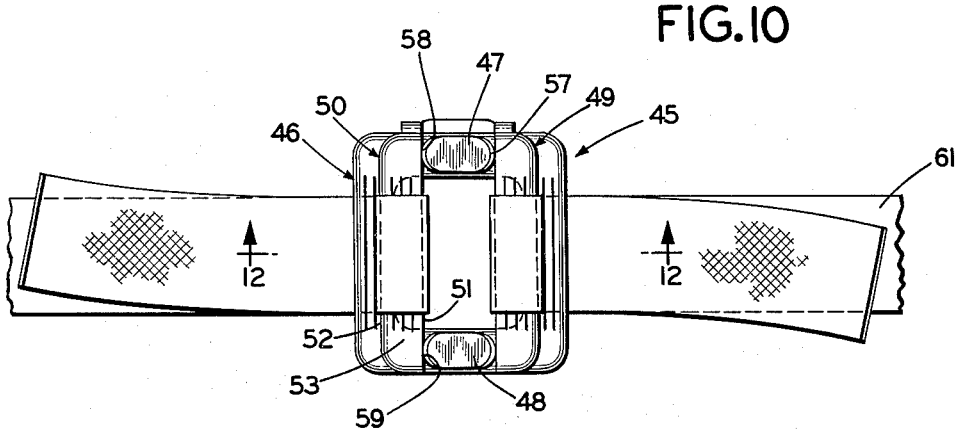
FIG.11
FIG.12
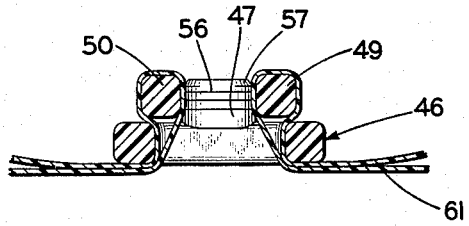
FIG.13
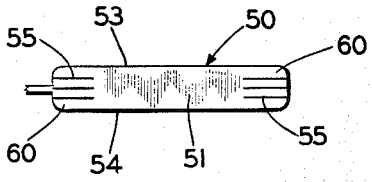

BUCKLE CONSTRUCTION

BACKGROUND OF THE INVENTION

1. Field of the Invention

The invention relates to a buckle construction and in particular to an integrally molded plastic buckle for securing flexible strapping. More particularly, the invention relates to a buckle construction for securing non-metallic strapping about an object without piercing or indenting the strapping material.

2. Description of the Prior Art

Buckles of various constructions and arrangements have been used in the past and are being used today for securing together the ends of strapping material used to bind or secure an object. Metal strapping was used to a great extent in the past for securing together large objects requiring considerable tension on the strapping. Plastic strapping, however, has replaced the use of this metal strapping for many applications.

Various buckle constructions have been devised for securing the ends of flexible or plastic strapping which secure the strap ends by clamping or wedging the strapping between separate frame members to eliminate piercing or indenting the strap material. Examples of such buckle constructions are shown in U.S. Pat. Nos. 139,777, 151,191, 728,206, 2,914,827, 3,121,270 and 3,377,666.

Such buckles have not proven entirely satisfactory in that two separate members are required which makes installation thereof time consuming and more difficult than a single member buckle. Also, many of these prior constructions do not provide the desired gripping ability, and permit the strap to loosen and slip in the buckle. Likewise, many of these prior constructions are formed of metal which is both costly and difficult to produce.

Recent buckle constructions have been produced as relatively inexpensive integrally molded plastic members which eliminate many of the problems encountered with prior two-piece, metal buckle constructions. Examples of these plastic buckles are shown in U.S. Pat. Nos. 3,206,816, 3,271,831, 3,336,639 and 3,414,943.

Difficulties have been encountered with the type of buckle constructions as shown in U.S. Pat. No. 3,206,816 in that the rigid connection between one end of the pair of clamping fingers increases the difficulty of placing the fingers in the loops formed in the strap ends. Both fingers must be inserted within the strap loops before the buckle can be moved to folded position. Likewise, when used for high tension applications, tension on the fingers may cause twisting of the front finger ends with respect to the rigid connection therebetween causing slipping of the strap within the buckle and possible fracture of the finger at the junctions with the rigid rear cross member.

Buckle constructions of the type as shown in U.S. Pat. No. 3,414,943 have eliminated some of these prior buckle installation problems by providing the strap clamping fingers with separate flexible connecting hinge strips. These separate strips permit independent movement of the fingers during strap securement. Such constructions, however, have not proven entirely satisfactory in that upon tensioning of the strap, the fingers are pulled in a generally inwardly downwardly direction and any slight unequal force causes the unattached finger ends to turn. This turning causes an unequal force on the rear portion of the fingers resulting in fracture thereof, especialy when considerable tension is required and is applied by mechanical means. Also, the unattached ends of the fingers may contact each other and override causing slippage of the strap, and increasing the difficulties of using the same.

No buckle construction for flexible strapping of which I am aware has eliiminated these installation problems by providing a pair of independently movable fingers having a pair of fixed posts between the spaced end of the fingers, which posts absorb much of the tensioning forces and equally distributes the remaining forces on the fingers preventing twisting, turning and premature fracture of the fingers.

SUMMARY OF THE INVENTION

Objectives of the invention include providing an improved buckle construction for securing flexible strapping about an object, in which the buckle is molded as a unitary member of plastic having a pair of fingers hingedly mounted on a base member by thin strips of plastic integral therewith; providing a buckle construction having a pair of verticaly extending posts formed on the base member which extend between the spaced ends of the fingers when the fingers are in folded strap engaging position to prevent displacement or shifting of the fingers when tension is applied to a strap secured thereby; providing such a buckle construction in which the fingers may have a continuously straight configuration or alternatively have inwardly projecting end portions which are adapted to engage the posts upon tensioning of the strapping; and providing an improved buckle construction which is relatively inexpensive to mass produce, simple to install, able to withstand relatively high strapping tension without breaking, and which eliminates difficulties heretofore encountered with known buckle constructions, achieves the objectives indicated, and solves problems and satisfies needs existing in the art.

These objectives and advantages are obtained by the improved buckle construction the general nature of which may be stated as including, a generally rectangular base having a pair of opposite side members and a pair of opposite end members forming a rectangular aperture therebetween; a pair of spaced fingers; strips of flexible material integral with the end members hingedly connecting the fingers to one of the end members; the fingers being foldable into superimposed relationship with the base side members to hold the ends of flexible strapping when the strapping is looped about the fingers and under the corresponding side member; a pair of post means formed integrally with the base end members, each of the post means projecting upwardly from the midpoint of one of the end members; the fingers each having a straight bar-like portion terminating in end portions; the end portions each having an inner surface; the inner end surface of each finger being spaced at both ends of the finger from the end surfaces of the other finger to form spaces therebetween; the post means extend into the spaces between the finger end surfaces when the fingers are in folded strap holding position; the post means each having a width approximately equal to the width of the respective space between the finger inner end surfaces into which space the post means extends when in strap engaging position; and the finger end surfaces engaging the post means when tension is applied to a strap secured thereby to distribute the tension on the fingers and post means.

BRIEF DESCRIPTION OF THE DRAWINGS

Preferred embodiments of the invention — illustrative of the best mode in which applicant has contemplated applying the principles — are set forth in the following description and shown in the drawings and are particularly and distinctly pointed out and set forth in the appended claims.

FIG. 8 is a sectional view taken on line 8—8, FIG. 7;

FIG. 10 is a top plan view similar to FIG. 1, showing a modified form of the improved buckle construction;

FIG. 11 is a top plan view of the modified buckle construction shown in folded strap engaging position;

FIG. 12 is a sectional view taken on line 12—12, FIG. 11; and

FIG. 13 is a fragmentary elevational view of the inside surface of one of the fingers, looking in the direction of Arrows 13—13, FIG. 10.

Similar numerals refer to similar parts throughout the drawings.

DESCRIPTION OF THE PREFERRED EMBODIMENTS

First Embodiment

Figure 1:
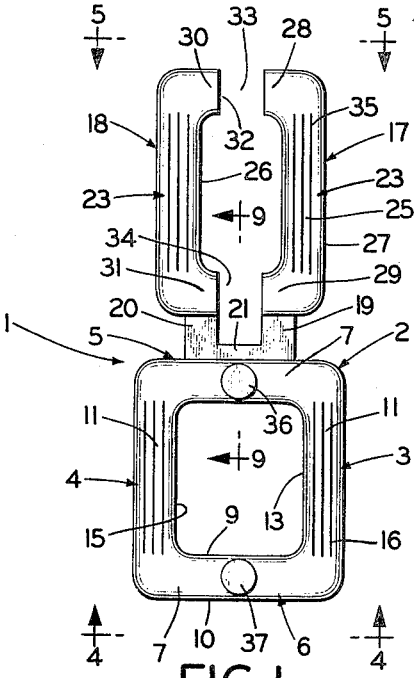
FIG. 1 is a top plan view of the improved plastic strap buckle construction in unfolded position.
Figure 3:
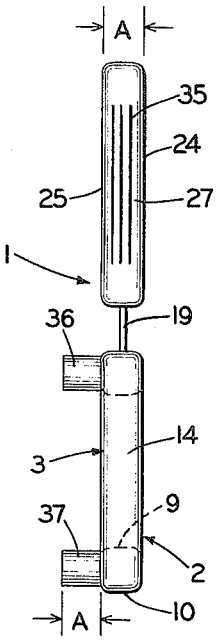
FIG. 3 is a right hand side elevation of the buckle shown in FIG. 1.
Figure 2:
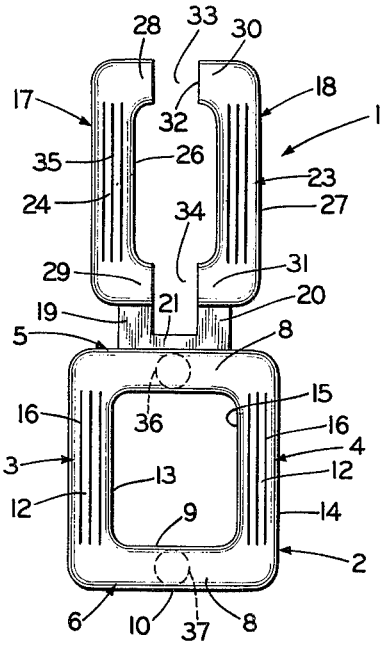
FIG. 2 is a bottom plan view of the buckle construction shown in FIG. 1.
Figure 4:
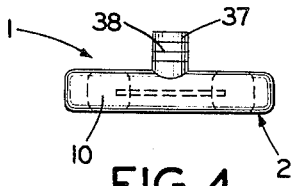
FIG. 4 is an end elevation looking in the direction of Arrows 4—4, FIG. 1.

The improved buckle construction is indicated generally at 1, and is shown particularly in FIGS. 1–3 in unfolded position. Buckle 1 is formed of a plastic material, preferably polypropylene and is molded as an integral member. Buckle 1 includes a rectangular frame-like base 2 formed by spaced pairs of side members 3 and 4, and end members 5 and 6, which form a rectangular aperture 15 therebetween. Frame members 3–6 each having a generally rectangular shape in cross-section (FIG. 7) with rounded edges to prevent cutting into a strap held thereby.

Each end member 5 and 6 has top and bottom surfaces 7 and 8, and inner and outer surfaces 9 and 10. Each side member 3 and 4 has top and bottom surfaces 11 and 12, and inner and outer surfaces 13 and 14. A plurality of longitudinally extending grooves or serrations 16 are formed in at least top, bottom and inner surfaces 11, 12 and 13 of side members 3 and 4 to increase the gripping ability on a plastic strap secured thereby.

A pair of clamping fingers 17 and 18 are individually, movably mounted on end member 4 by relatively thin strips of flexible plastic 19 and 20, respectively. Strips 19 and 20 may be joined along end member 5 by a web of material 21 to prevent tearing and separation of the strips from base 2. Fingers 17 and 18 are shown in open or unfolded position in FIGS. 1–3, and in folded or closed position in FIGS. 6–8 clamping the ends of a plastic strap 22.

Figure 6:
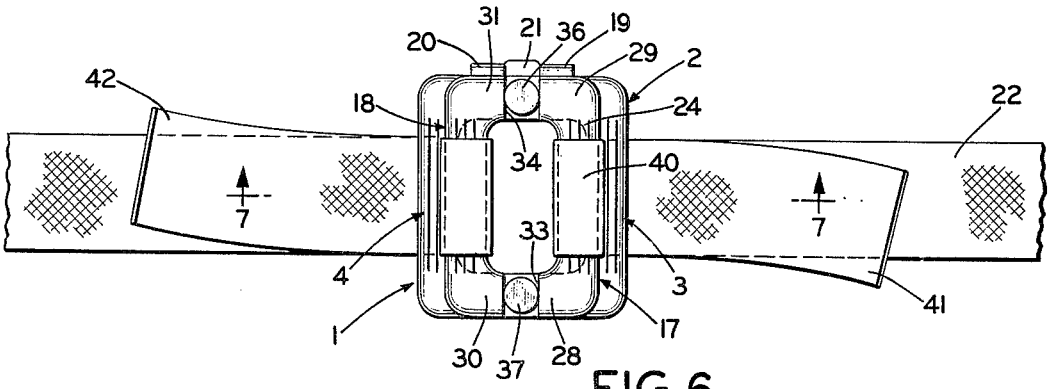
FIG. 6 is a top plan view with the buckle being folded into strap engaging position with a portion of a strap being shown secured thereby.
Figure 7:
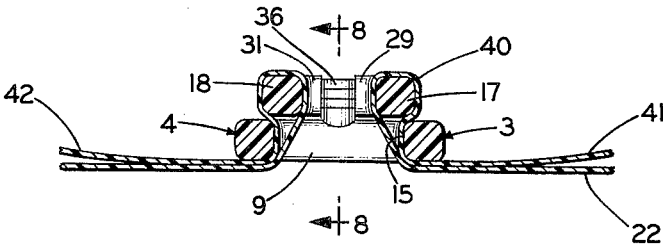
FIG. 7 is a sectional view taken on line 7—7, FIG. 6.

Each finger 17 and 18 preferably has a bar-like straight portion 23 with a rectangular cross-sectional configuration, formed with rounded edges (FIG. 7). Fingers 17 and 18 preferably are similar in cross-sectional size and dimension to base members 3–6. Each finger 17 and 18 includes upper and lower surfaces 24 and 25, and inner and outer surfaces 26 and 27. Surfaces 24 are designated as the upper surfaces with reference to the fingers being in the closed position of FIGS. 6–8. Grooves or serrations 35, similar to groove 16 of side members 3 and 4, preferably are formed in surfaces 24–27 of fingers 17 and 18 to increase the gripping ability of the fingers on strap 22.

Figure 9:
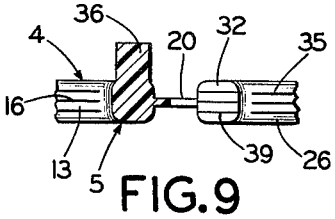
FIG. 9 is a sectional view taken on line 9—9, FIG. 1.

Fingers 17 and 18 are formed with inwardly projecting ends 28–29 and 30–31, respectively, which terminate in inner end faces 32 (FIG. 9). Fingers 17 and 18 are spaced apart and form spaces 33 and 34 between finger ends 28–30 and 29–31, respectively (FIGS. 1 and 2).

Figure 5:
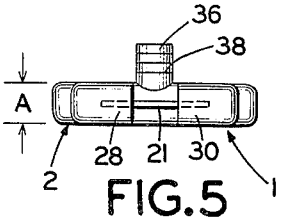
FIG. 5 is an end elevation looking in the direction of Arrows 5—5, FIG. 1.

In accordance with the invention, posts 36 and 37 are formed integrally with end members 5 and 6, respectively, and project vertically upwardly from the midpoint thereof. Posts 36 and 37 preferably have a height approximately equal to or greater than the thickness of finger ends 28–31, indicated by Arrows A in FIGS. 3 and 5. Posts 36 and 37 have a cylindrical configuration as shown in the drawings, with a diameter approximately equal to the distances of spaces 33 and 34 between faces 32 of finger ends 28–31 (FIGS. 6 and 7).

Posts 36 and 37 may be formed with a plurality of circular grooves or serrations 38 which engage grooves or serrations 39 formed in finger end faces 32 (FIG. 9), the purpose of which is discussed below.

Fingers 17 and 18 when in folded position, are superimposed on and overlap side members 3 and 4, as shown in FIGS. 6, 7 and 8, with posts 36 and 37 being located within spaces 34 and 33 between finger ends 30–31 and 28–29, respectively.

Strap 22 is secured by buckle 1 by inserting a looped portion 40 through buckle aperture 15. Finger 17 while in a semifolded position is inserted within strap loop 40. The strap end then is pulled snug moving finger 17 into closed position, as shown in FIG. 7. This same procedure is followed for finger 18, while retaining finger 17 and looped portion 40 in closed position.

Tensioning pressure is applied outwardly, either manually or mechanically, to one or both strap ends 41 and 42. Fingers 17 and 18 are pulled in a downwardly inwardly direction with respect to base frame 2. This downward inward movement of fingers 17 and 18 forces finger end faces 32 tightly against posts 36 and 37. In accordance with the concept of the invention, the interaction between finger ends 28–31 and posts 36–37 prevents twisting of the fingers and distributes the tensoning force equally along the fingers and in equal, opposite relationship on posts 36 and 37, which absorb the same. Posts 36 and 37 absorb much of the tensioning force on strap 22 and distributes the remaining force along fingers 17 and 18 nearly eliminating any binding, twisting or turning forces acting upon the fingers. Such unequal forces on known strap buckle fingers cause shifting or movement of the fingers, resulting in the strap slipping and becoming loose on the object bound thereby. Equal compressive forces are applied to posts 36 and 37, which forces are absorbed easily thereby nearly eliminating the possibility of the posts breaking. Likewise, equal distribution of the forces along the fingers enable increased tension to be applied on the strapping without the danger of finger breakage. Serrations 38 and 39 on the post and finger end faces, reduce movement of the finger ends with respect to the posts, and nearly eliminate the fingers from overriding the posts.

Second Embodiment

A modified form of the buckle construction of the invention is indicated at 45, and is shown in FIGS. 10–12. Buckle 45 includes a base frame 46 which is similar to frame 2 of buckle 1, except for modified posts 47 and 48 formed thereon. A pair of fingers 49 and 50 are hingedly mounted on base 46, and are similar to fingers 17 and 18 of buckle 1, except that fingers 49 and 50 have a generally continuous cross-sectional configuration throughout their lengths, eliminating the inturned finger ends 28–31 of buckle 1. Fingers 49 and 50 each have a generally rectangular configuraton formed by inner and outer surfaces 51 and 52, and top and bottom surfaces 53 and 54.

Serrations 55 are formed on inner surfaces 60 at the end portions of fingers 49 and 50 (FIG. 13) which engage serrations 56 formed on posts 47 and 48 when buckle 45 is in closed strap engaging position, in a similar manner as the engagement of serrations 38 and 39 of buckle 1.

Posts 47 and 48 have a generally oval cross-sectional configuration (FIGS. 10 and 11) and may have a beveled top edge 57. The major axes of posts 47 and 48 (indicated by Arrow B) are approximately equal to the distance between the inner surfaces 60 at the finger end portions. The spaced finger end portions form spaces 58 and 59 therebetween, similar to spaces 33 and 34 of buckle 1.

The procedure for installing and securing strap 61 in binding position with buckle 45 is similar to the procedure described above for buckle 1 and strap 22. Posts 47 and 48 absorb much of the tensioning force, with the remainder of the tensioning force being distributed equally on fingers 49 and 50 due to the engagement of the finger end portions with posts 47 and 48 preventing twisting and turning of the fingers during installation.

SUMMARY

The improved buckle construction 1 and 45 are each provided with a pair of individually movable fingers facilitating the placement of the fingers through looped ends of the straps. The individual fingers enable one finger of the pair to be held in closed strap engaging position during placement of the other finger through the looped strap end.

In accordance with the main concept of the invention, a pair of posts is formed on the end frame members at the midpoints thereof. The posts each have a width or thickness, measured in a direction parallel to the end frame member approximately equal to the distance of the space between the inner surfaces of the finger end portions, between which the post is located when the fingers are in folded position. The posts being located at both ends of the fingers, instead of just a single end, prevent any shifting or turning of the fingers with respect to the base frame. During tensioning of the strap the fingers are drawn into and pressed against the posts, which, since abutting both finger ends prevent any turning of the fingers. The posts also absorb much of the tensioning forces and distribute the remaining force components equally on the straight bar-like portions of the fingers and the finger ends, reducing undue stress on a concentrated area of the finger which occurs when the pair of posts is not present.

The grooves formed in the post surfaces and in the inner surfaces of the finger end portions reduces the possibility of the finger ends moving upwardly along the posts if unequal forces are applied to the strap or should the buckle be twisted by an operator during installation. Likewise, the posts preferably have a height approximately equal to or greater than the thickness of the post engaging surfaces on the finger ends to reduce the possibility of post override by the finger ends.

In the foregoing description certain terms have been used for brevity, clearness and understanding, but no unnecessary limitations are to be implied therefrom beyond the requirements of the prior art, because such words are used for description purposes herein and are intended to be broadly construed.

Moreover, the description and illustration of the invention is by way of example, and the scope of the invention is not limited to the exact details of the construction shown or described.

Having now described the features, discoveries and principles of the invention, the manner in which the improved buckle construction is constructed, assembled and operated, the characteristics of the new construction, and the advantageous, new and useful results obtained; the new and useful structures, devices, elements, arrangements, parts, and combinations are set forth in the appended claims.

I claim:

1. Buckle construction for securing the ends of flexible strapping about an object, including a. a rectangular base having a pair of opposite side members and a pair of opposite end members forming a single rectangular aperture therebetween;

b. first and second individual posts formed integrally with the base, each of said posts projecting upwardly from the midpoint of a respective one of the base end members;

c. a pair of spaced fingers movable between open and closed positions, each of said fingers having a straight bar-like portion terminating in end portions, with said end portions each having an inner surface;

d. individual strips of flexible material hingedly connecting the fingers to one of the end members;

e. the fingers extending in spaced parallel relationship outwardly from the said one base end member when in open position with the inner surfaces of opposite finger end portions forming spaces therebetween, and with the width of said spaces being predetermined and generally equal to the width of the posts;

f. the fingers being foldable individually toward the base in a direction generally transverse to the end members and parallel with the side members when moving from open to closed position;

g. the posts being located each in a respective space between the finger end portions when the fingers are in closed strap engaging position; and h. the finger inner end surfaces engaging the respective interposed post during tensioning of the strapping to equally distribute the tensioning force on the fingers and posts.

2. The buckle construction defined in claim 1 in which the end portions of the fingers each have a greater width than the straight bar-like portions and extend inwardly toward the end portions of the other finger; and in which the post means are similar and are cylindrically shaped and have a diameter approximately equal to the width of the spaces between the finger end surfaces.

3. The buckle construction defined in claim 2 in which groove means is formed on the post means; in which the inner surfaces of the end portions are formed with groove means; and in which the groove means of the finger ends engage the groove means of the post means when tension is applied to the strapping.

4. The buckle construction defined in claim 1 in which the post means each have an oval cross-sectional configuration; in which the end portions of the fingers each have a width equal to the width of the fingers; and in which the major axes of the post means are approximately equal to the spaces between the finger end portions.

5. The buckle construction defined in claim 4 in which groove means are formed in the post means and in the inner surfaces of the finger end portions; and in which the groove means of the post means engage the groove means of the finger end portions when tension is applied to the strapping.

6. The buckle construction defined in claim 1 in which the height of the post means are equal to or greater than the height of the finger end portions.

7. An improved buckle construction for securing the ends of flexible strapping about an object, the buckle being of the type which includes a generally rectangular base having a pair of opposite side members and a pair of opposite end members which form a rectangular aperture therebetween, and in which a pair of spaced fingers is hingedly connected to one of the end members by individual strips of flexible material whereby said fingers can be folded into superimposed relationship with the base side members to hold the ends of the strapping when the strapping is looped about the fingers and under the corresponding side member; wherein the improvement includes: a pair of similar cylindrically-shaped post means formed integrally with the base end members, each of said post means projecting upwardly from the midpoint of one of said end members; groove means formed on the post means; the fingers each having a straight bar-like portion terminating in end portions, with the end portions each having an inner surface; said inner end surfaces of each finger being spaced at both ends of the finger from the inner end surfaces of the other finger to form spaces therebetween; the finger end portions having greater widths than the bar-like portions and extend inwardly toward the end portions of the other finger; groove means formed on the inner surfaces of the finger end portions; the post means each having a diameter approximately equal to the width of the respective space between the finger inner end surfaces into which space the post means extend when in strap engaging position; and the groove means of the finger inner end surfaces engaging the groove means of the post means during tensioning of the strapping to equally distribute the tensioning force on the fingers and post means.

8. An improved buckle construction for securing the ends of flexible strapping about an object, the buckle being of the type which includes a generally rectangular base having a pair of opposite side members and a pair of opposite end members which form a rectangular aperture therebetween, and in which a pair of spaced fingers is hingedly connected to one of the end members by individual strips of flexible material whereby said fingers can be folded into superimposed relationship with the base side members to hold the ends of the strapping when the strapping is looped about the fingers and under the corresponding side member; wherein the improvement includes: a pair of post means formed integrally with the base end members, each of said post means projecting upwardly from the midpoint of one of said end members; said post means each having an oval cross-sectional configuration; groove means formed in the post means; the fingers each having a straight bar-like portion terminating in end portions; said end portions each having a width equal to the width of the bar-like portion; the end portions each having an inner surface; groove means formed in the inner surfaces of the finger end portions; the inner end surfaces of each finger being spaced at both ends of the finger from the end surfaces of the other finger to form spaces therebetween; the major axis of each of the post means being approximately equal to the space between the finger end portions with the post means extending into the spaces between the finger end surfaces when the fingers are in strap holding position; and the groove means of the finger inner end surfaces engaging the groove means of the post means during tensioning of the strapping to equally distribute the tensioning force on the fingers and post means.

* * * * *